US005312312A

United States Patent [19]

Fernandez et al.

[11] Patent Number: 5,312,312

[45] Date of Patent: May 17, 1994

[54] WALL MOUNTED EXERCISE CYCLE APPARATUS

[76] Inventors: Geraldine Fernandez; John L. Fernandez, both of 10 Watch Hill Dr., Fishkill, N.Y. 12524

[21] Appl. No.: 18,147

[22] Filed: Feb. 16, 1993

[51] Int. Cl.[5] ..... A63B 22/06

[52] U.S. Cl. ..... 482/60; 482/904

[58] Field of Search ..... 482/57, 60, 83, 904, 482/65

[56] References Cited

U.S. PATENT DOCUMENTS

D. 226,670 4/1973 Nickels ..... 482/60

3,008,265 11/1961 Converse ..... 482/60

3,100,640 8/1963 Weitzel ..... 482/60

3,107,915 10/1963 Looney ..... 482/65

3,227,447 1/1966 Baker et al. ..... 482/60

*Primary Examiner*—Stephen R. Crow

*Attorney, Agent, or Firm*—Leon Gilden

[57] ABSTRACT

An exercise cycle is arranged for mounting to a vertical wall support, having spaced parallel braces rotatably mounting an exercise wheel therebetween, with the exercise wheel arranged for selective frictional engagement with a roller. A modification of the invention includes a support structure permitting selective mounting of the cycle to a floor support.

4 Claims, 4 Drawing Sheets

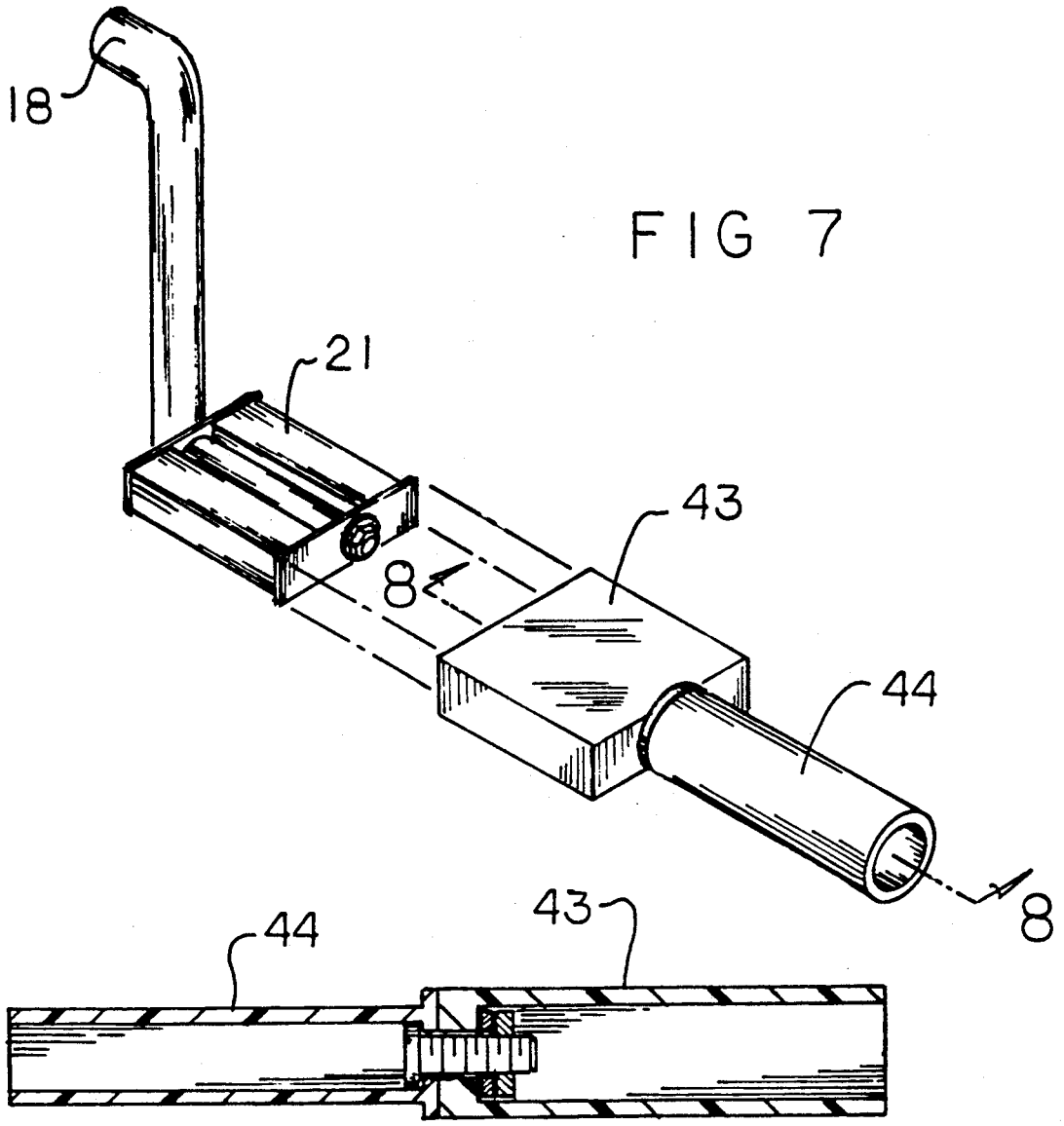
FIG 7
FIG 8
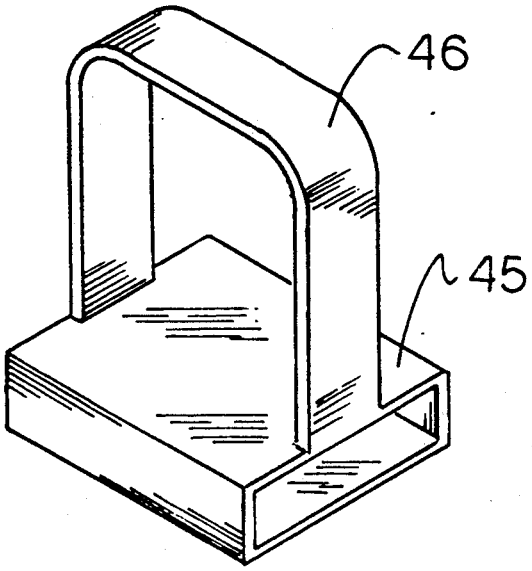
FIG 9

WALL MOUNTED EXERCISE CYCLE APPARATUS

BACKGROUND OF THE INVENTION

1. Field of the Invention

The field of invention relates to exercise apparatus, and more particularly pertains to a new and improved wall mounted exercise cycle apparatus wherein the same permits convenient and efficient mounting of an exercise cycle device to a vertical wall support.

2. Description of the Prior Art

Exercise apparatus of various types have been utilized throughout the prior art for permitting at home exercise for individuals and for therapeutic purposes such as indicated in U.S. Pat. No. 4,925,184 having a bed mounted leg exercise structure.

U.S. Pat. Nos. 4,934,695; 5,005,829; and 5,039,088 are further examples of cycle type exercise structure.

The instant invention attempts to overcome deficiencies of the prior art by providing for an exercise cycle structure providing ease of mounting and use relative to a vertical wall support and in this respect, the present invention substantially fulfills this need.

SUMMARY OF THE INVENTION

In view of the foregoing disadvantages inherent in the known types of exercise cycle apparatus now present in the prior art, the present invention provides a wall mounted exercise cycle apparatus wherein the same permits ease of mounting to a wall and selectively to a floor support positioning the cycle support plate in a vertical orientation. As such, the general purpose of the present invention, which will be described subsequently in greater detail, is to provide a new and improved wall mounted exercise cycle apparatus which has all the advantages of the prior art exercise apparatus and none of the disadvantages.

To attain this, the present invention provides an exercise cycle arranged for mounting to a vertical wall support, having spaced parallel braces rotatably mounting an exercise wheel therebetween, with the exercise wheel arranged for selective frictional engagement with a roller. A modification of the invention includes a support structure permitting selective mounting of the cycle to a floor support.

My invention resides not in any one of these features per se, but rather in the particular combination of all of them herein disclosed and claimed and it is distinguished from the prior art in this particular combination of all of its structures for the functions specified.

It is therefore an object of the present invention to provide a new and improved wall mounted exercise cycle apparatus which has all the advantages of the prior art exercise apparatus and none of the disadvantages.

It is another object of the present invention to provide a new and improved wall mounted exercise cycle apparatus which may be easily and efficiently manufactured and marketed.

It is a further object of the present invention to provide a new and improved wall mounted exercise cycle apparatus which is of a durable and reliable construction.

An even further object of the present invention is to provide a new and improved wall mounted exercise cycle apparatus which is susceptible of a low cost of manufacture with regard to both materials and labor, and which accordingly is then susceptible of low prices of sale to the consuming public, thereby making such wall mounted exercise cycle apparatus economically available to the buying public.

Still yet another object of the present invention is to provide a new and improved wall mounted exercise cycle apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an isometric illustration of an adapter housing structure to permit manual manipulation of the exercise cycle.

FIG. 8 is an orthographic view, taken along the lines 8—8 of FIG. 7 in the direction indicated by the arrows.

FIG. 9 is an isometric illustration of a stirrup structure utilized selectively by the invention.

DESCRIPTION OF THE PREFERRED EMBODIMENT

Figure 1:
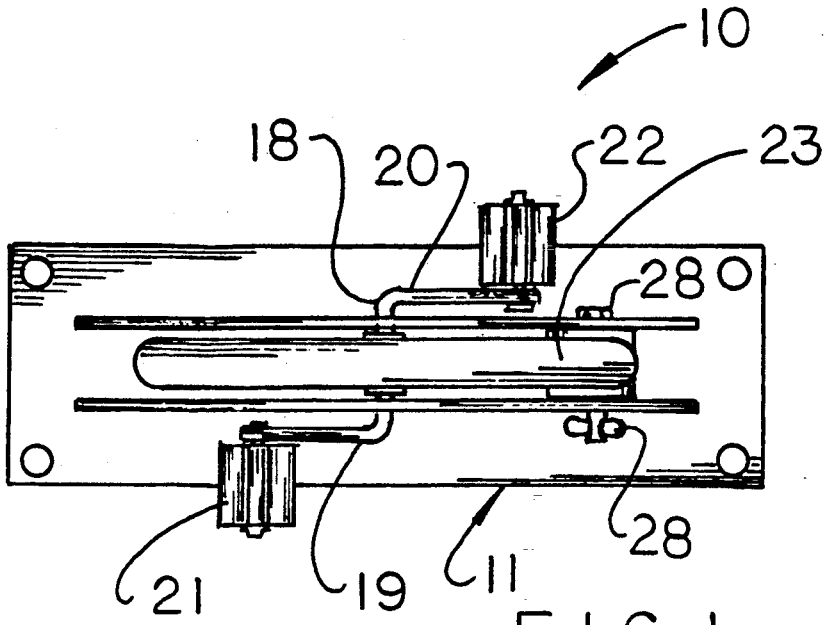
FIG. 1 is an orthographic top view of the invention.
Figure 2:
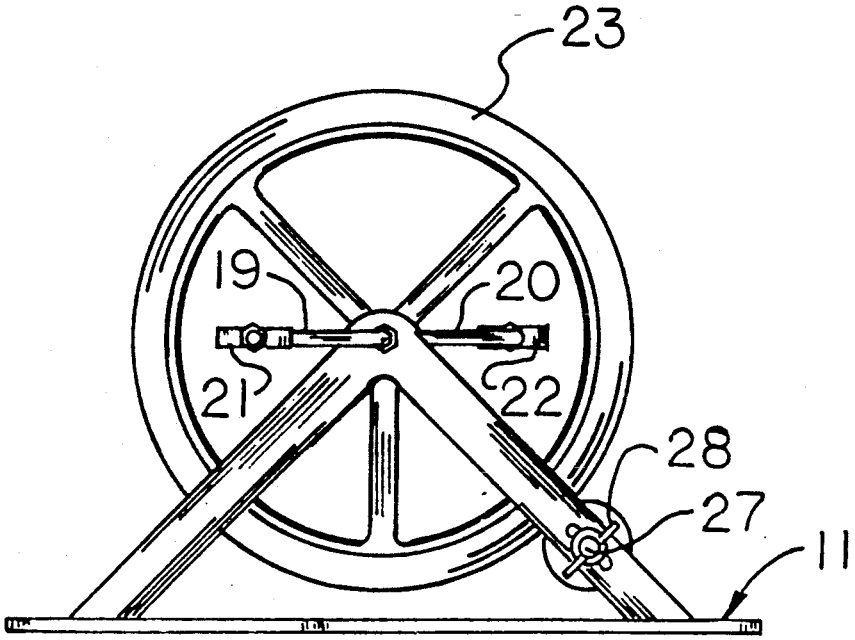
FIG. 2 is an orthographic side view of the invention.
Figure 3:
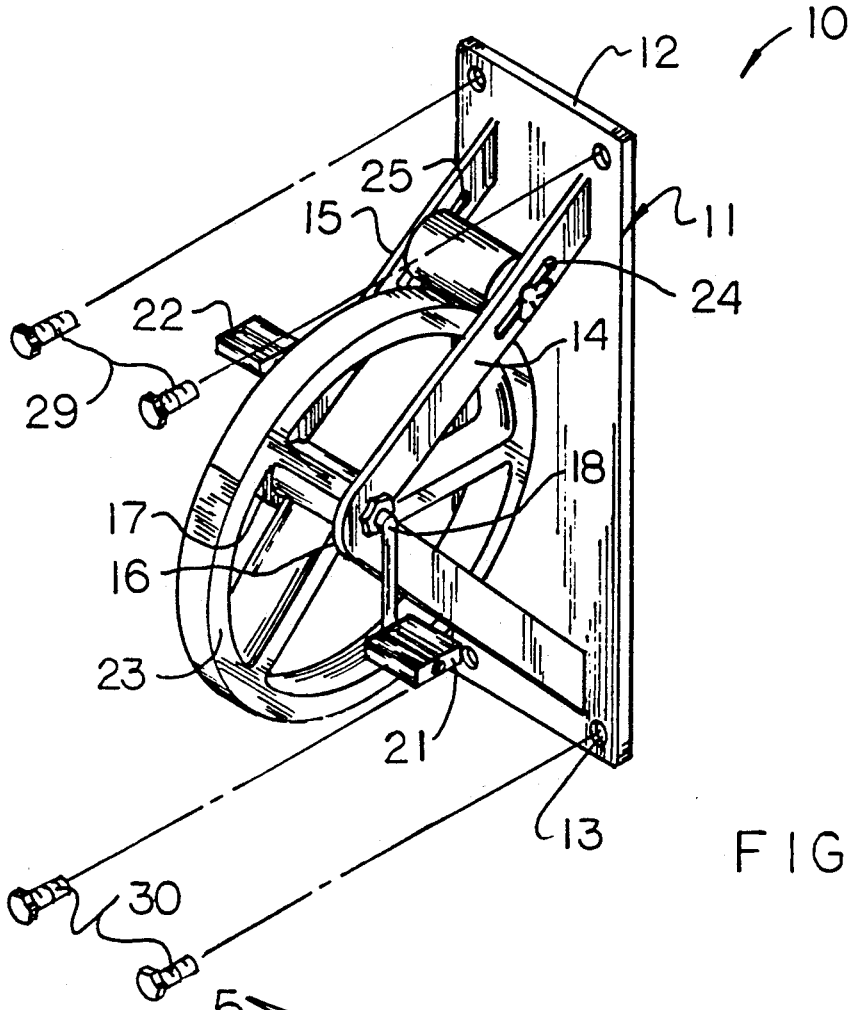
FIG. 3 is an isometric illustration of the invention.

With reference now to the drawings, and in particular to FIGS. 1 to 9 thereof, a new and improved wall mounted exercise cycle apparatus embodying the principles and concepts of the present invention and generally designated by the reference numeral 10 will be described.

More specifically, the wall mounted exercise cycle apparatus 10 of the instant invention essentially comprises a mounting plate 11 having a first end 12 spaced from a second end 13. Respective first and second generally V-shaped braces 14 and 15 having respective first and second brace apexes 16 and 17 are fixedly mounted to the mounting plate in a parallel coextensive relationship relative to one another directed from the first end 12 to the second end 13 positioned in adjacency relative to the first end 12 and the second end 13. A crank shaft 18 is rotatably and orthogonally directed between the first and second V-shaped braces 14 and 15, and more specifically intersecting and directed through the apexes 16 and 17. The crank shaft 18 includes a first rod 19 orthogonally mounted to the crank shaft in a first orientation, with the crank shaft having a second rod 20 fixedly mounted to the crank shaft directed in a second direction, wherein the first rod 19 is positioned adjacent the first brace 14, with the second rod 20 positioned adjacent the second brace 15. The first rod 19 pivotally mounts a first pedal 21 orthogonally relative thereto, with the second rod 20 pivotally and orthogonally mounting a second pedal 22 relative to the second rod. The crank shaft is fixedly secured to the hub of a wheel member 23 to provide for rotation of the wheel member 23 rotatably mounted between the first and second braces 14 and 15.

Respective first and second slots 24 and 25 are arranged parallel and coextensive relative to one another to the respective first and second braces 14 and 15 adjacent the first end 12 of the mounting plate and includes an axle 27 directed through the first and second braces 14 and 15 and through the respective first and second slots 24 and 25, with the friction roller 26 rotatably mounted about the axle 27, with the axle 27 including an axle lock fastener 28 mounted to each distal end of the axle in adjacency to each of the slots 24 and 25 to permit adjustment of the friction roller and selective frictional engagement relative to the wheel 23 to permit altering of resistance relative to the wheel during its rotation by the crank shaft 18 and the associated rod and pedal assembly.

In this manner, an individual may lie on a floor portion relative to the mounting plate 11 for exercise while in a lying orientation utilizing the organization of the invention.

Figure 4:
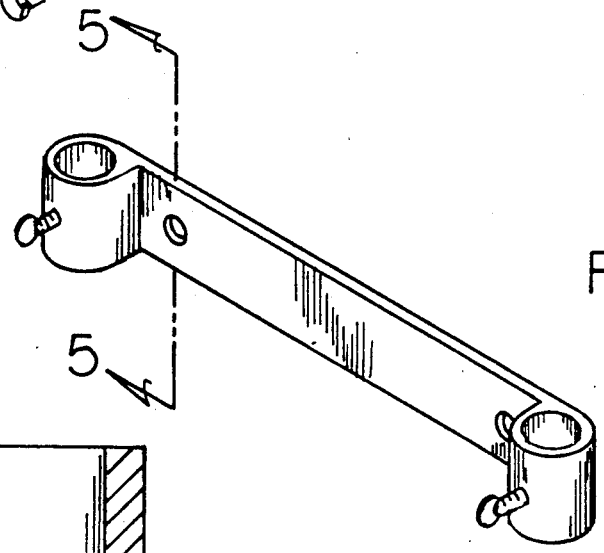
FIG. 4 is an isometric illustration of an adapter plate structure utilized by the invention.
Figure 5:
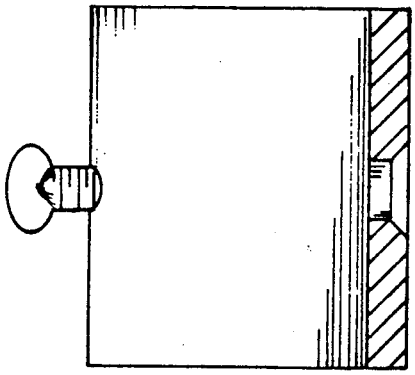
FIG. 5 is an orthographic view, taken along the lines 5—5 of FIG. 4 in the direction indicated by the arrows.
Figure 6:
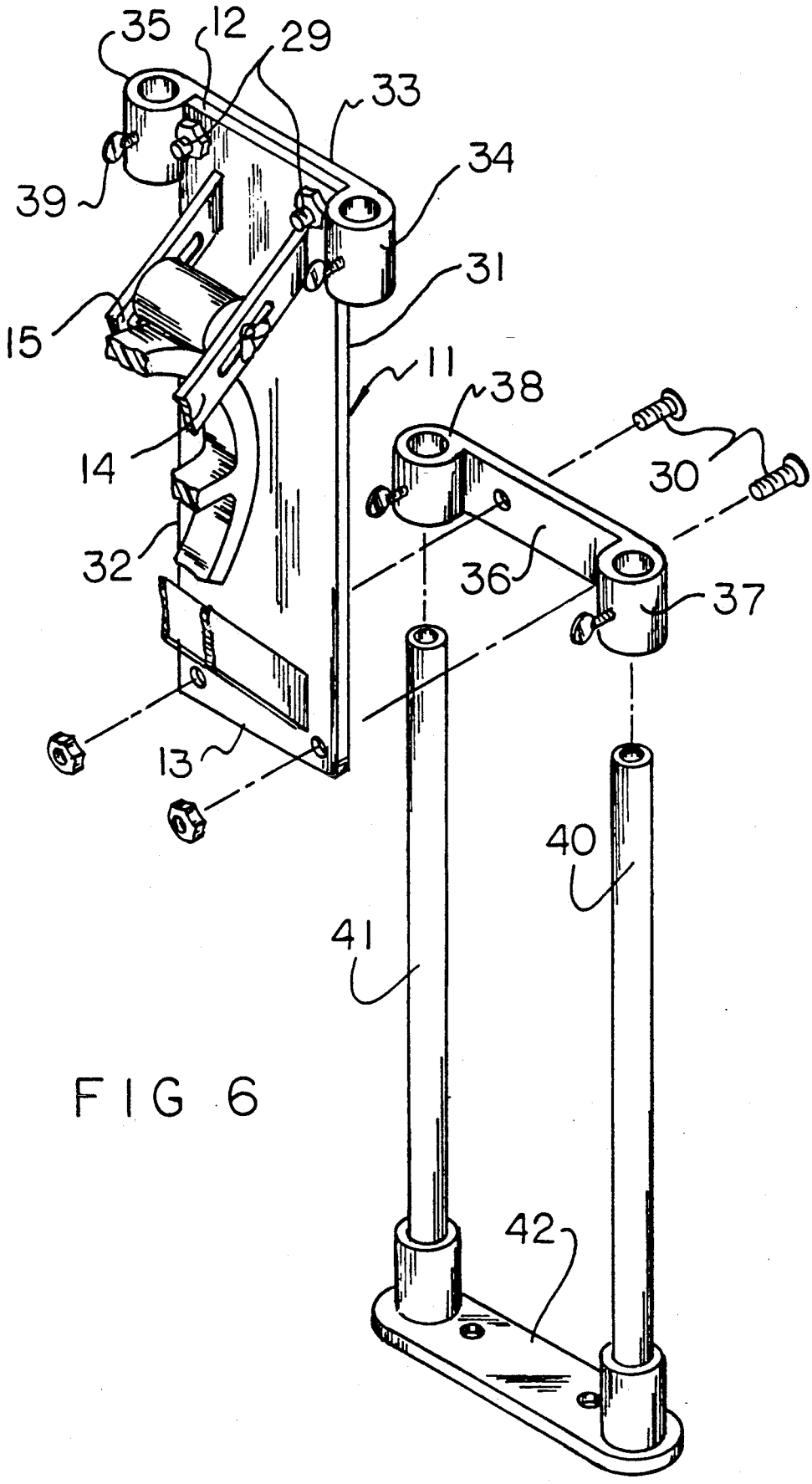
FIG. 6 is an isometric illustration of the adapter plate structure employed in association with a floor support tube structure.

The FIGS. 4–6, and more specifically FIG. 6, indicates respective first and second adapter plates 33 and 36 of identical construction mounted to the mounting plate 11 in adjacency to the respective first and second ends 12 and 13. The first adapter plate 33 includes respective first and second tubes 34 and 35 arranged parallel one another whose axes are parallel relative to one another and orthogonally oriented relative to the crank shaft 18, with the first and second tubes 34 and 35 extending in adjacency to the first and second sides 31 and 32 projecting forwardly of the mounting plate 11, with the second adapter plate 36 having third and fourth tubes 37 and 38 positioned in adjacency to the first and second sides 31 and 32, with the first and third tubes 34 and 37 coaxially aligned and the second and fourth tubes 35 and 38 coaxially aligned, and with the first and third tubes 34 and 37 slidably received over a first mounting tube 40 and the second and fourth tubes 35 and 38 respectively slidably received over a second mounting tube 41, with the first and second mounting tubes 40 and 41 fixedly and orthogonally mounted to a mounting tube support plate 42 arranged for fixed securement to an underlying floor support. A tube fastener 39 is orthogonally directed into each of the tubes 34, 35, 37, and 38 for fixed securement to one of the first and second mounting tubes 40 and 41. In this manner, vertical adjustment of the mounting plate 11 is afforded relative to an underlying floor to permit floor mounting of the organization when wall support engagement and support is not convenient or practical.

The FIG. 7 indicates the use of a pedal housing 43 frictionally receiving a pedal of the first and second pedals 21 and 22. It should be noted that a plurality of such pedal housings 43 are provided, with each having a pedal housing rod 44 rotatably mounted to the associated pedal housing 43, with the pedal housing rod 44 parallel to the crank shaft 18 permitting manual manipulation and orientation of the wheel by permitting grasping manually of the pedal housing rods 44.

The FIG. 9 indicates the use of a strap housing 45 frictionally receiving an associated pedal therewithin, having a strap loop 46 secured thereto for enhanced securement of an individual's foot relative to an associated pedal member 21 and 22 in use of the organization. The strap structure 46 functions as a stirrup in securement and positioning of an individual's foot relative to an associated pedal.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A wall mounted exercise cycle apparatus, comprising, a mounting plate, the mounting plate having a first end spaced from a second end, and a first side spaced from a second side, and a first V-shaped brace and a second V-shaped brace fixedly mounted to the mounting plate, with the first brace and the second brace arranged in a parallel coextensive relationship relative to one another, and the first V-shaped brace and the second V-shaped brace extending from the first end towards the second end, the first brace having a first brace apex, the second brace having a second brace apex spaced from the mounting plate a predetermined spacing, and a crank shaft rotatably directed through the first brace apex and the second brace apex orthogonally oriented relative to the first brace and the second brace.

the crank shaft having a first rod fixedly and orthogonally mounted to a first end of the crank shaft, and a second rod fixedly and orthogonally mounted to the second end of the crank shaft, with the first rod having a first pedal, the second rod having a second pedal, and the crank shaft having a wheel member fixedly mounted to the crank shaft between the first brace and the second brace, and the wheel member having a diameter less than the predetermined spacing; wherein the first side and the second side of the mounting plate are arranged in a parallel relationship relative to one another, and a first adapter plate fixedly mounted to the mounting plate adjacent the first end, and a second adapter plate fixedly mounted to the mounting plate (adjacent) the second end, with the first adapter plate having a first tube adjacent to the first side, and a second tube (adjacent) to the second side, the second adapter plate having a third tube (adjacent) to the first side, and a fourth tube adjacent to the second side, with the first tube and the third tube coaxially aligned, and the second tube and the fourth tube are coaxially aligned, and a floor mounted support plate, with the floor mounting tube fixedly and orthogonally mounted to the floor mounted support plate, with the first mounting tube and the second mounting tube arranged in a parallel coextensive relationship relative to one another, and the first mounting tube received through the first tube and the third tube, and the second mounting tube received through the second tube and the fourth tube, wherein the first tube, the second tube, the third tube, and the fourth tube each include a tube fastener directed therethrough wherein said tube fastener of said first tube and said third tube engages the first mounting tube and the tube fastener of the second tube and the fourth tube engages the second mounting tube.

2. An apparatus as set forth in claim 1 wherein the first brace includes a first slot, the second brace includes a second slot, the first slot and the second slot arranged in a parallel coextensive relationship relative to one another in adjacency to the first end, and a friction roller axle received through the first slot and the second slot, the friction roller axle rotatably mounting a friction roller thereabout, with the friction roller arranged for engagement with the wheel member, and the axle including at least one lock fastener for securing the friction roller axle to the first slot and the second slot.

3. An apparatus as set forth in claim 1 including at least one pedal housing frictionally engaging at least the first pedal, wherein the pedal housing includes a pedal housing rod pivotally mounted to the first pedal, with the pedal housing rod arranged in a parallel relationship relative to the crank shaft for manual manipulation of the wheel member.

4. An apparatus as set forth in claim 3 wherein the apparatus further includes a strap housing frictionally engaging one of said first pedals and said second pedal, with the strap housing including a strap loop secured thereto.

* * * * *